US007819289B2

(12) United States Patent
Willis

(10) Patent No.: US 7,819,289 B2
(45) Date of Patent: Oct. 26, 2010

(54) FOAM SOAP GENERATOR

(75) Inventor: Daniel M. Willis, Clinton, OH (US)

(73) Assignee: Joseph S Kanfer, Richfield, OH (US)

( * ) Notice: Subject to any disclaimer, the term of this patent is extended or adjusted under 35 U.S.C. 154(b) by 979 days.

(21) Appl. No.: 11/404,617

(22) Filed: Apr. 14, 2006

(65) Prior Publication Data

US 2007/0241137 A1 Oct. 18, 2007

(51) Int. Cl.
*B67D 7/78* (2010.01)

(52) U.S. Cl. ..... 222/190; 222/135; 222/145.5; 222/630

(58) Field of Classification Search ..... 222/190, 222/135, 630, 145.5; 239/434.5, 433, 434; 261/28; 4/623
See application file for complete search history.

(56) References Cited

U.S. PATENT DOCUMENTS

| | | | | | |
|---|---|---|---|---|---|
| 3,709,437 | A | * | 1/1973 | Wright | 239/343 |
| 4,620,983 | A | * | 11/1986 | Zimmer | 427/8 |
| 5,271,530 | A | | 12/1993 | Uehira et al. | 222/190 |
| 5,443,569 | A | | 8/1995 | Uehira et al. | 222/190 |
| 5,540,362 | A | * | 7/1996 | Azuma et al. | 222/642 |
| 5,544,788 | A | * | 8/1996 | Meyer | 222/190 |
| 5,570,819 | A | | 11/1996 | Uehira et al. | 222/190 |
| 5,725,129 | A | | 3/1998 | Chapin et al. | 222/190 |
| 5,779,104 | A | | 7/1998 | Reidel | 222/190 |
| 5,813,576 | A | | 9/1998 | Iizuka et al. | 222/190 |
| 5,857,591 | A | | 1/1999 | Bachand | 222/1 |
| 6,053,364 | A | | 4/2000 | van der Heijden | 222/145.6 |
| 6,082,586 | A | | 7/2000 | Banks | 222/95 |
| 6,612,468 | B2 | | 9/2003 | Pritchett et al. | 222/190 |
| 6,840,408 | B1 | | 1/2005 | Foster et al. | 222/190 |
| 7,147,133 | B2 | * | 12/2006 | Brouwer et al. | 222/145.5 |
| 7,364,053 | B2 | * | 4/2008 | Ophardt | 222/190 |
| 2002/0056730 | A1 | | 5/2002 | van de Heijden | 222/190 |
| 2002/0070238 | A1 | | 6/2002 | Pritchett et al. | 222/189.11 |
| 2004/0060945 | A1 | * | 4/2004 | Cater et al. | 222/190 |
| 2004/0069817 | A1 | | 4/2004 | Jacques | 222/529 |
| 2004/0149777 | A1 | | 8/2004 | Santagiuliana | 222/190 |
| 2006/0011655 | A1 | | 1/2006 | Ophardt | 222/190 |

* cited by examiner

*Primary Examiner*—Kevin P Shaver
*Assistant Examiner*—Jonathan Wood
(74) *Attorney, Agent, or Firm*—Renner, Kenner, Greive, Bobak, Taylor & Weber

(57) ABSTRACT

A foam soap generator is provided for implementation with various types of foam soap delivery systems. The foam soap generator includes converging air and liquid soap passages at a mixing chamber, where a prefoam is generated for ultimate extrusion through a porous passage member. In one embodiment of the invention, the soap and air are delivered through coaxial tubes, with the soap being introduced axially into the mixing chamber and the air being introduced radially angularly. In another embodiment, the liquid soap is drawn into an entrainment zone by high velocity air passing through the air passageway and into the mixing chamber.

5 Claims, 2 Drawing Sheets

FOAM SOAP GENERATOR

TECHNICAL FIELD

The invention herein resides in the art of delivery systems and, more particularly, to soap delivery systems of the type typically employed for hand hygiene. More specifically, the invention relates to a soap foam generator adaptable for use in various types of delivery systems and particularly adapted for generating soap foam at a delivery head remote from a source of liquid soap.

BACKGROUND ART

The use of soap dispensers for hand washing has now become widely known and accepted. Typically, such soap dispensers dispense a quantity of soap which is then worked into a lather by the user when combined with water on the hands. Recently, there has been a general acceptance of foam soap delivery systems. In such systems, liquid soap is combined with air, typically under force or pressure, and then driven through a mesh, screen or porous passage to finish or homogenize the soap into a uniform stable composition. In some systems, a mixing chamber is employed prior to the porous structure or passage in order to prepare a prefoam of randomly sized and spaced bubbles. The mixing chamber and porous passage are generally presented at a foamer head that is immediately adjacent the drive mechanism for the liquid and air. In general, these drive systems are typically pistons within cylinders or pumps to achieve the pressurization and drive of the liquid soap and air.

In the past, little attention has been given to the development of foamer heads that are adaptable for use in systems where the liquid soap source is remote from the dispensing head. Indeed, the prior art foamer heads have typically been of a rudimentary nature, with little regard for the specifics of the design or the configuration of the constituent elements. While the prior art foamer heads have generally been of a satisfactory nature, little attention has been given to the efficacy of soap foam generation to achieve a desired uniformity and integrity of the resulting foam. Moreover, where foam soap is to be dispensed from an area remote from the liquid soap source, the prior art has generally taught the generation of the foam close to the liquid soap source, with its subsequent delivery to a dispensing head remote from that source. However, such systems have generally proven to be problematic. It has been found that foam is difficult to drive for any distance through a conduit. Breakdown of the foam occurs, resulting in reduced volumes of soap being dispensed on each dispensing cycle, and with the ultimate dispensing of liquid soap globules. It has also been found that such remote delivery systems have resulted in extremely low output volumes on subsequent dispensing operations, and even total failures to dispense when the period of time between dispensing operations has been sufficient to allow the soap foam within the conduit to fully breakdown. Other problems have been evidenced with a "wet" foam output on subsequent dispensing operations, resulting from the breakdown of foam in the conduit into a liquid form.

In systems where the dispensing head is remote from the point of foam generation, it has been found that the liquid and/or air cylinders of this system have required careful design to ensure sufficient "suck-back" force on the return stroke of the dispensing operation to draw residual foam back away from the dispensing head to preclude drips and the like.

The remote dispensing heads referenced herein are typically present in what are referred to as counter-mount systems, in which the soap reservoir is maintained beneath the counter and the dispensing head is above the counter, the two being interconnected by conduits that are three or more feet in length. The problems of foam breakdown and suck-back failure are characteristic of such systems.

There is a need in the art for an improved soap foam generator, adaptable for use in any of a variety of delivery systems, and particularly in remote dispensing systems, such as counter-mount systems, in which the air and liquid sources are remote from the dispensing head.

DISCLOSURE OF INVENTION

In light of the foregoing, it is a first aspect of the invention to provide a soap foam generator that generates a high quality, consistent and uniform soap foam.

Another aspect of the invention is the provision of a soap foam generator that is adaptable for use with any of various drive systems.

Yet another aspect of the invention is the provision of a soap foam generator that may be used with pressurized or unpressurized soap systems.

Still a further aspect of the invention is the provision of a soap foam generator that is adaptable for use with remote systems, where the dispensing head is remote from the liquid soap source.

Yet an additional aspect of the invention is the provision of a soap foam generator that may be employed in systems that keep air and soap separated until reaching the foamer head immediately adjacent a dispensing head.

The foregoing and other aspects of the invention that will become apparent as the detailed description proceeds are achieved by a foam generator for a soap dispenser, comprising: a housing having an air inlet and a liquid soap inlet; a mixing chamber; an air passage extending between said air inlet and said mixing chamber; a liquid passage extending between said liquid inlet and said mixing chamber; and wherein said air and liquid passages converge at said mixing chamber.

Other aspects of the invention that will become apparent herein are attained by a foam generator for a soap dispenser, comprising: a liquid passage; an air passage converging with said liquid passage at an area of convergence for converging air from said air passage with liquid from said liquid passage; a mixing chamber receiving said converged air and liquid and generating a foam therefrom; and a porous passage at an end of said mixing chamber receiving and finishing said foam as to consistency, uniformity and stability.

DESCRIPTION OF DRAWINGS

For a complete understanding of the aspects, techniques and structures of the invention, reference should be had to the following detailed description and accompanying drawings wherein.

BEST MODE FOR CARRYING OUT THE INVENTION

Figure 1:
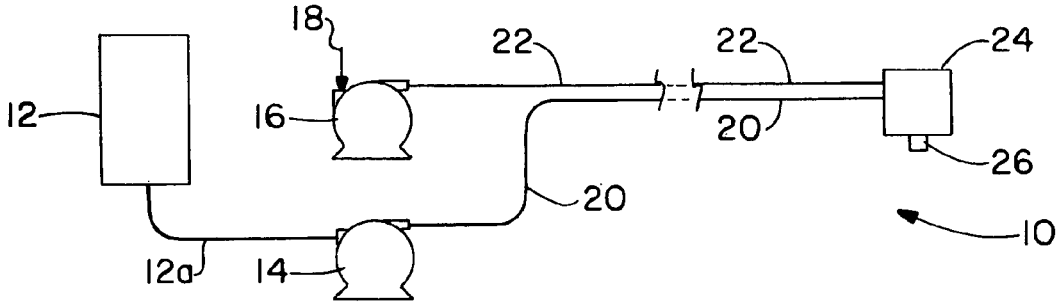
FIG. 1 is a schematic diagram of a remote foam soap delivery system according to the invention.

Referring now to the drawings and more particularly FIG. 1, it can be seen that a soap foam delivery system made in accordance with the invention is designated generally by the numeral 10. It will be appreciated herein that when reference is made to soap, it is intended to extend to lotions, disinfectants and the like. The delivery system 10 includes a source of liquid soap 12 interconnected through a conduit 12*a* to a liquid soap pump 14. An air pump 16, provided with an air inlet 18, is also provided, it being understood that the ingredients of soap foam are liquid soap and air. The outlet of the liquid soap pump 14 is connected to a liquid flow line 20, with the outlet of the air pump 16 being similarly connected to an air flow line 22. The lines 20, 22 may be totally separate, presented in side by side relation, or coaxial with each other, as will become apparent herein. In any event, the liquid flow line 20 and air flow line 22 are connected to a soap foam generator 24, in which the air and liquid soap are combined for the development of a prefoam, then extruded through a porous passage member and out of a dispensing head or outlet 26.

It will be appreciated that the foam soap delivery system 10 of FIG. 1 is shown as being a remote dispensing system, with the liquid soap source 12 and pumps 14, 16 being remote from the soap foam generator 24 and dispensing head 26. In a typical counter-mount system, the conduits 20, 22 could have a length on the order of three or more feet.

Figure 2:
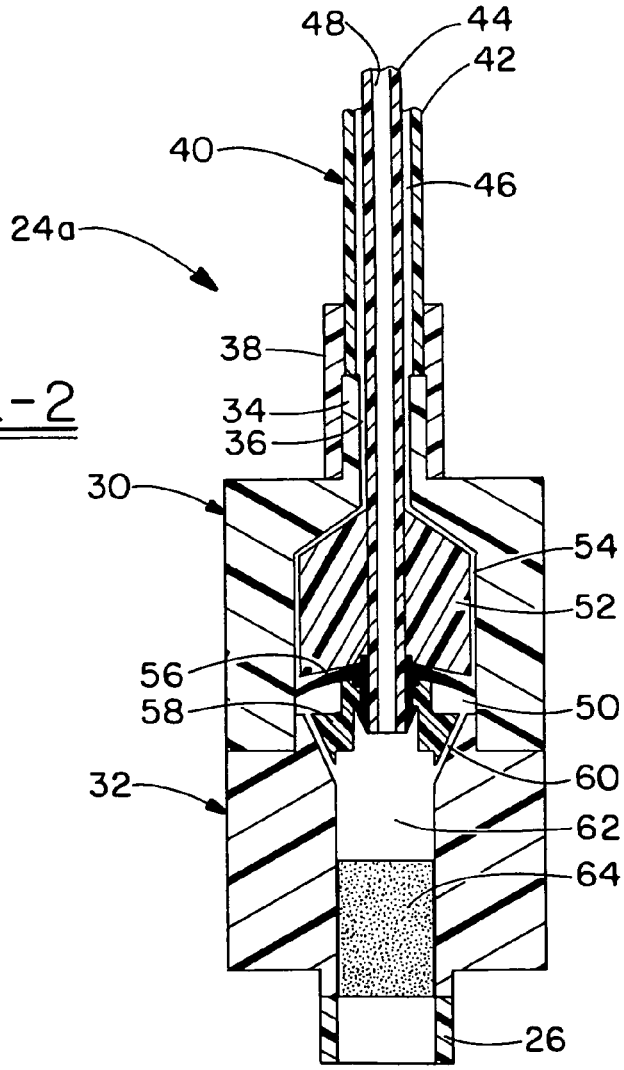
FIG. 2 is a cross sectional view of a first embodiment of a soap foam generator made in accordance with the invention.

With reference now to FIG. 2, it can be seen that a first embodiment of a soap foam generator, as might be employed in the system of FIG. 1, is designated by the label 24*a*. The soap foamer 24*a* comprises an upper housing block 30 and a lower housing block 32, although it will be appreciated by those skilled in the art that any suitable structure or configuration could be employed.

The upper housing 30 has a neck 34 defining a bore 36 centrally therethrough. A collar 38 is received over the neck 30 to receive and constrain a coaxial tube assembly 40 to the upper housing block 30. As shown, the outer tube 42 of the assembly 40 abuts the end of the neck 34, while the inner tube 44 passes through the bore 36 and into the interior of the block 30. This arrangement of the coaxial tube assembly 40 is held in place and secured by means of the collar 38.

It will be appreciated that an annular passage 46 is defined between the outer tube 42 and inner tube 44. In the embodiment presented, this annular passage 46 is adapted to carry air into the soap foamer. A cylindrical passage 48 is provided within the interior of the inner tube 44 to carry liquid soap to the soap foamer. An expanded bore 50 is provided within the upper housing block 30, the bore 50 interconnecting with the bore 36 and receiving a nozzle insert 52 therein. The nozzle insert 52 has a central bore through which passes the inner tube 44. The nozzle insert 52 also serves to define an expanded annular passage 54 between the exterior surface of the nozzle insert 52 and the interior surface of the bore 50 of the upper housing block. This expanded annular passage 54 interconnects with and is an extension of the annular passage 46, devised as an air passage for the soap foamer.

An umbrella valve 56, of suitable flexible elastomeric material, is fit over the inner tube 44 and extends outwardly to normally seal against the interior walls of the bore 50. A fitment 58 is also received about the inner tube 44 and serves to secure the umbrella valve 56 against the nozzle insert 52. The fitment 58 also serves to define, in conjunction the lower block 32, an inwardly directed annular nozzle or passageway connected to the expanded annular passage 54. As is shown, this inwardly directed annular nozzle or passageway 60 is configured as an inverted truncated cone. The passage 60 angles inwardly into a mixing chamber 62, which is generally cylindrical in shape. The inwardly directed annular passage 60 is angled on the order of 20°-60° and preferably on the order of 30° inwardly. The cylindrical passage 48 of the inner tube 44 enters the mixing chamber axially. Accordingly, air that is driven into the mixing chamber 62 through the inwardly directed annular passage 60 converges with the liquid soap introduced into the mixing chamber 62 through the passage 48 of the inner tube 44.

A porous structure 64, such as a mesh, screen, sponge, open cell foam member or the like, is received by the lower housing block 32 at an outlet end of the mixing chamber 62. This porous passage device 64 is maintained between the mixing chamber 62 and an output dispensing head 26, as shown.

In operation, the coaxial tube assembly 40 is connected to appropriate sources of air and liquid soap, the two being typically driven either by piston assemblies or pumps. Upon actuation, pressurized air is driven down the annular passages 46, 54 and 60 to be angularly inwardly directed into the mixing chamber 62 from about the circumference thereof. At the same time, an amount of liquid soap is dispensed into the mixing chamber 62 through the cylindrical passage 48. The air and soap converge in the mixing chamber 62, where the resulting agitation from their movement produces a prefoam of random sized and spaced bubbles within the mixing chamber 62. This prefoam is extruded through the porous passages 64 and out of the dispensing head 26 as a rich, thick, consistent and uniform soap of bubbles of uniform size, shape and spacing.

Figure 3:
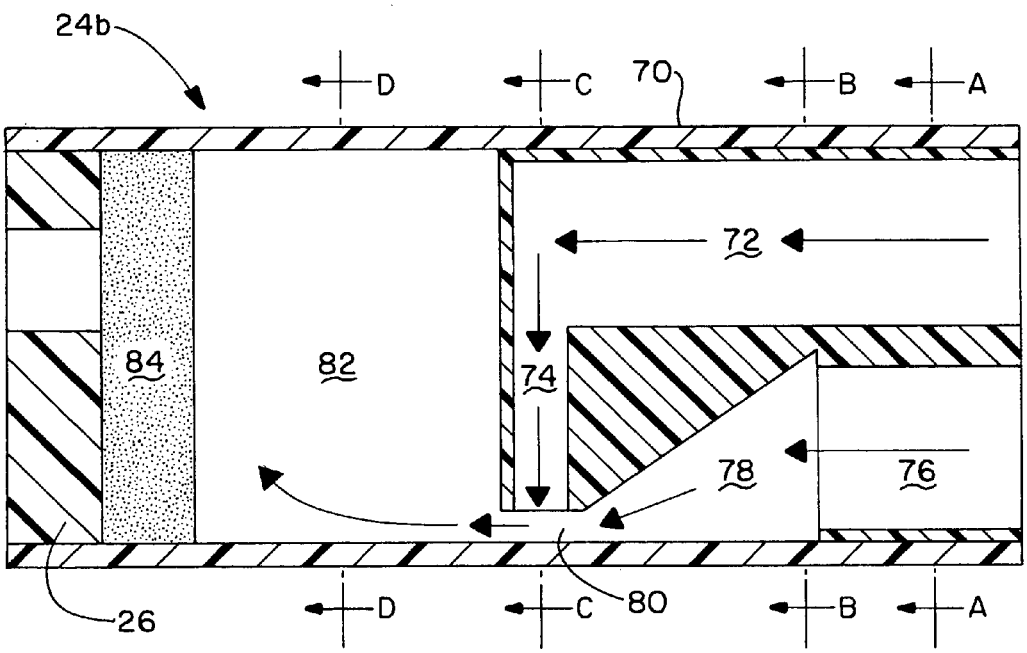
FIG. 3 is a partial sectional view of a second embodiment of a soap foam generator according to the invention.
Figure 4:
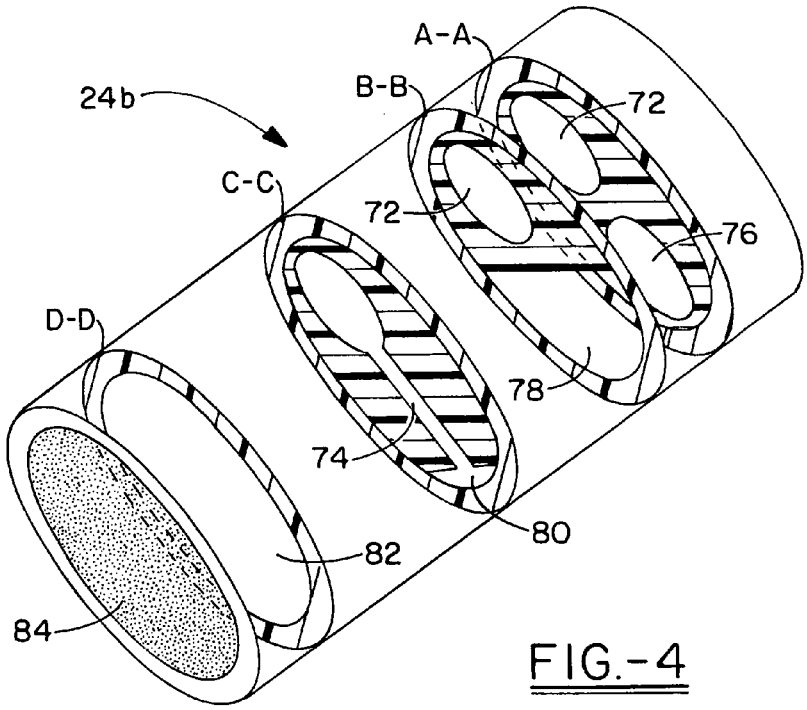
FIG. 4 is a cross sectional view of the embodiment of FIG. 3, showing the elements thereof along axially displaced sections.

With reference to FIGS. 3 and 4, an appreciation can be obtained of yet another soap foam generator 24*b*. Here, a housing 70 is provided with a converging air and liquid path immediately before a mixing chamber and before a porous passage assembly. Specifically, a first liquid path 72, preferably cylindrical in nature, is orthogonally intersected by a second liquid path or passage 74, again also preferably of a cylindrical nature. In somewhat similar fashion, a first air path 76 provides an inlet to the housing 70 and is of a generally cylindrical nature. The air path 76 interconnects with a second air path or passage 78 that is of a sectored cylindrical nature, linearly diminishing in size, as best appreciated from combined reference to FIGS. 3 and 4. It will be appreciated that this reduction in cross sectional area of the air passageway results in increased velocity of the air passing therethrough during operation.

As again shown in both FIGS. 3 and 4, the second liquid passageway 74 converges with the constricting second air passageway 78 at an entrainment zone 80. In the entrainment zone 80, liquid from the second liquid passageway 74 is entrained in the high velocity air passing through the second air passageway 78 and the liquid soap entrained within the air is taken into a mixing chamber 82, where a prefoam is again formed of randomly sized and spaced bubbles, which are subsequently extruded through the porous passage member 84 and dispensed out of the dispensing head 26.

It will be appreciated that the first liquid passage 72 and first air passage 76 will typically be adapted with nipples or like connectors (not shown) to receive input tubes and the like. Accordingly, air and liquid are passed to the soap foam generator 24*b*, from any desired source. In generally, the air passages 76 will be connected to a source of air that is delivered under pressure in order to introduce a high velocity airstream into the entrainment zone 80. The liquid soap may be similarly introduced into first liquid passage 72. In such a way, both liquid soap and air are introduced under pressure or force into the entrainment zone 80, and then into the mixing chamber 82 along a peripheral region thereof. The liquid soap and air are agitated in the mixing chamber 82 to form the prefoam as discussed above.

It is also contemplated that the first liquid passage 72 may comprise a temporary storage or staging area for liquid soap, which is not introduced into the entrainment zone 80 under pressure, but is drawn thereinto by a venturi action generated by the high velocity air in the air passages 76, 78 and passing through the zone 80. In this manner, the provision of a small amount or dose of liquid soap within the passages 72, 74 may be achieved in any suitable manner, such as a pumping action upon the return stroke of the dispensing system. In any event, the methodology just discussed will require only the introduction of pressurized air into the soap foamer 24*b*, in contradistinction to liquid soap and air both being pressurized.

It will further be appreciated that even where the liquid soap is introduced under pressure into the passages 72, 74, the high velocity air passing through the entrainment zone 80 will serve to draw the liquid soap, even when pressurized, by a venturi action.

While the liquid soap and air are introduced by coaxial tubing in the embodiment for the foam 24*a*, side by side parallel tubes would be employed with the foamer 24*b*, as is apparent from the side-by-side relationship of the pads 72, 76.

Thus it can be seen that the various aspects of the invention have been attained by the structures and processes presented and described above. While in accordance with the patent statutes only the best mode and preferred embodiments of the invention have been presented and described in detail, the invention is not limited thereto or thereby. Accordingly, for an appreciation of the scope and breadth of the invention, reference should be made to the following claims.

What is claimed is:

1. A soap dispenser, comprising:

a liquid pump communicating with a liquid flow line and advancing liquid upon actuation through said liquid flow line;

an air pump communicating with an air flow line and advancing air upon actuation through said air flow line;

a foam generator remote from said liquid pump and said air pump by a distance defined by said liquid flow line and said air flow line, said foam generator comprising:

a housing having an air inlet receiving air advanced through said air flow line and a liquid soap inlet receiving liquid advanced through said liquid flow line;

a mixing chamber;

an annular air passage extending between said air inlet and said mixing chamber and entering said mixing chamber about the entire periphery of the mixing chamber in a direction that is angled inwardly relative to said periphery;

a liquid passage extending between said liquid inlet and said mixing chamber, wherein said air and liquid passages converge at said mixing chamber; and an annular valve interposed within said air passage prior to entry into said mixing chamber.

2. The soap dispenser according to claim 1, further comprising a porous passage at an end of said mixing chamber opposite an end where said air and liquid passages converge.

3. The soap dispenser according to claim 1, wherein said liquid passage enters said mixing chamber axially.

4. The soap dispenser according to claim 3, wherein said air and said liquid passages are coaxial.

5. The soap dispenser according to claim 4, further comprising a coaxial pair of inlet tubes, a liquid inlet tube within an air inlet tube.

* * * * *